US006747590B1

(12) United States Patent
Weber

(10) Patent No.: US 6,747,590 B1
(45) Date of Patent: Jun. 8, 2004

(54) ALTERNATE COMMAND SIGNAL DECODING OPTION FOR A REMOTELY CONTROLLED APPARATUS

(76) Inventor: Harold J. Weber, P.O. Box 169, Centerville, MA (US) 02632

( * ) Notice: Subject to any disclaimer, the term of this patent is extended or adjusted under 35 U.S.C. 154(b) by 271 days.

(21) Appl. No.: 09/779,992

(22) Filed: Feb. 12, 2001

(51) Int. Cl.[7] ..... G08C 19/12

(52) U.S. Cl. ..... 341/176; 341/173; 340/825.69; 340/825.72; 340/825.52; 348/734

(58) Field of Search ..... 348/725, 734; 341/173, 176; 359/245; 340/825.52, 825.72, 825.69

(56) References Cited

U.S. PATENT DOCUMENTS 3,754,187 A * 8/1973 Deming ..... 340/825.72
4,037,201 A * 7/1977 Willmott ..... 340/825.53
4,334,221 A * 6/1982 Rosenhagen et al. ..... 463/6
4,529,980 A * 7/1985 Liotine et al. ..... 340/825.52
4,626,847 A * 12/1986 Zato ..... 340/825.56
4,878,052 A * 10/1989 Schulze ..... 340/825.69
4,886,434 A * 12/1989 Satow et al. ..... 418/55.5
4,912,463 A * 3/1990 Li ..... 340/825.69
4,914,428 A * 4/1990 Kobayashi et al. .... 340/825.62
4,988,992 A * 1/1991 Heitschel et al. ..... 340/825.69
5,081,534 A * 1/1992 Geiger et al. ..... 348/734
5,148,159 A * 9/1992 Clark et al. ..... 340/825.22
5,291,193 A * 3/1994 Isobe et al. ..... 340/825.69
5,341,166 A * 8/1994 Garr et al. ..... 725/153
5,386,251 A * 1/1995 Movshovich ..... 348/734
5,724,106 A * 3/1998 Autry et al. ..... 348/734
6,486,795 B1 * 11/2002 Sobel et al. ..... 340/825.72
RE37,986 E * 2/2003 Heitschel et al. ..... 700/90
6,529,556 B1 * 3/2003 Perdue et al. ..... 375/260

* cited by examiner

*Primary Examiner*—Albert K. Wong
(74) *Attorney, Agent, or Firm*—Harold Weber

(57) ABSTRACT

A portable remote controller for use with several remotely controlled entertainment devices which enables their concurrent usage in shared proximity without random interference between remotely submitted and individually directed encoded device commands. Discusses a provision for user accessible preselection between more than one alternative encoding and decoding data format when a command sent to one device appears to cause undesirable random interference with another device's functions. A user's preemptive selection of an alternate remote control encoding format assures the proximal, concurrent use of two substantially identical devices, such as two VCR-machines, without command interference. When a user finds objectionable command interference caused by mutual remote controller coupling, the user may select and preset a distinctly different code format for at least one of the remotely controlled devices.

11 Claims, 13 Drawing Sheets

ALTERNATE COMMAND SIGNAL DECODING OPTION FOR A REMOTELY CONTROLLED APPARATUS

BACKGROUND OF MY INVENTION

Cable and Satellite television reception is nearly ubiquitous in today's modern home. In the usual arrangement, a cable box (viz, set-top box) or satellite signal receiver is coupled with an ordinary television set (or televisor).

Video cassette recorder (VCR) machines are nearly universal in the modern home. VCR-machines have several distinct operating modes which may be "changed" by a remote controller. VCR-machines are typically hooked ahead of a televisor to provide playback of recorded tapes. Furthermore, they ordinarily include the equivalent of a televisor's "front end" components, e.g. a tuner and demodulator, which allows for off-the-air recording of television program content. Additionally, the television program received by the VCR-machine may re-modulate a subcarrier, usually centered on a locally vacant channel such as channel 3 or channel 4, and thenceforth couple the resulting signal with the televisor for viewable reception, either concurrent with recording of the program, or as a separate function.

DVD-machines have become popular for playback of pre-recorded digital video disk content. Similarly, DVD-machines may contain numerous features accessible through a remote controller.

At the present, digital video recorder (DVR) machines are beginning to make major inroads. The most common type affords up to 30 hours recording time on an internal hard disk drive. This class of machine is available from Panasonic and others and it is commonplace for most of the functions to be operable by a handheld remote controller.

Digital video disk recorders (DVDR) machines are also available which operate more like a VCR-machine, in that off-the-air programs may be recorded and played back, as well as offering to play-back prerecorded digital video disks, such as those offering motion picture presentations.

The primary betterment concerned with in this invention involves an ability for several pieces of equipment to operate in remotely controllable harmony with one-another. In principle, this means that there should be no erroneous unexpected command interaction between individual components of an overall equipment arrangement.

It is necessary to realize that the larger the number of pieces of equipment which are used together the greater the probability for some degree of random interaction becomes. Interaction may vary in extent. It may only affect the efficacity of a single command, or it may jam the entire remote interface. In particular, this potential interaction becomes an almost insurmountable problem when several similar devices are used together, such as the earlier mentioned "same make and model" VCR-machines.

Replication Video Tapes

Recognize that it is often desirable to be able to use two or more similar VCR-machines or other devices in close combination. Duplicating video tapes is a popular and desirable cause for using two VCR-machines together. Video tapes arc often duplicated for private purposes, such as weddings, showers, birthdays, anniversaries and holidays so various family members can have their own personal copies. Other widespread uses for duplication include church services and amateur sports (e.g., high school football, etc.)

I realize that tape duplicators are available, which in essence are two VCR-machine mechanisms hooked up in tandem with shared electronics. However, from an economic point of view, it is generally far less expensive to acquire two or more VCR-machines than a single duplicator machine. Two separate machines are also more useful in the average household, because each individual machine can be used with separate televisors even in different parts of a home. When a recording duplication session is anticipated, they are simply "brought together" for that purpose, after which they may again be placed elsewhere to service different televisors and different users. Furthermore, from an operational point of view, it makes more sense that the two VCR-machines be of the same type to avoid confusion in their usage.

The problem with using two of any "same kind" of remote controlled devices in close physical proximity is that the remote controller ordinarily utilized to operate them creates a command signal cross-talk between their individual control functions. In other words, commands sent to "one" machine will cause similar effects on the "other" machine. This is because devices of the "same kind" use essentially the same decoding instructions in response to the encoded commands sent by the remote controller.

In the past, I have been able to use two of the "same kind" of VCR-machines for tape duplication, etc. by placing the machines facing away from one-another, sort of back-to-back, where the remote controller signal beam is "visible" to only one machine at a time. I have enhanced this by placing a sheet of cardboard over the machines, sort of like an eyeshade, to limit a likelihood for a reflected beam erroneously reaching the unintended machine.

Sports Bar Environment

Several televisors are frequently used together in "sports bar" establishments. In practice, several televisors are variously mounted so as to be viewable by patrons in differing locations throughout the bar, saloon or restaurant establishment. Sometimes several televisors are used in immediate adjacency, each tuned to a "different" sports channel to allow for differing customer tastes. In this setting, it is often desirable to utilize all "the same make and model" televisors for aesthetic reasons, if no other. As a result, the likelihood for randomly occurring command interaction is substantial.

While it certainly may be obvious that using two devices, such as VCR-machines or televisors, of the "same make and model" together will give problems, this is not the only bothersome situation which may arise. It is not at all unusual for several dissimilar devices to be grouped and used together, such as with a cable box, a VCR-machine and a televisor. In this disparate setting it would be unusual for a remote controller to produce similar command response in any two of the devices. However, on the other hand it would not at all be unusual for the remote controller to cause "interference" and unwanted interaction and command errors to occur between devices.

Interference in the sense of its implications concerning devices used with this invention is most particularly described as the situation where the remote controller is used to send commands to a first device, and a second device is caused to have some undesirable level of random response to the command. The response may or may not be related to the intended instruction. In other words, if a remote controller is used to send a channel change instruction to a cable box to set it to channel "57" (for example), the same command may cause the input tuning of an associated televisor to randomly reset from channel "3" to channel "17", or to introduce some other erratic change in operation of the televisor. Obviously, the reverse situation may be present where a command particularly sent to the televisor may cause some spontaneous corruption of the immediate cable box settings, such as channel selection or power-up state.

Having experienced this type of interference between devices, I realized that a novel provision for preemptively "changing" the decoding pattern of one device relative with another would be advantageous. In other words, if cross-talk manifested as random command interference was experienced between two VCR machines or other devices (even of the same make and model), the best expedient would be to provide the user with a capability for introducing an alternate decoding instruction pattern to one or the other of the devices. In practice, such a change in the decode instruction data set could be altered by merely "flipping" a slide switch or the like on the back panel of the device. This slide switch may be embodied in a manner similar to the switch used for changing between channel 3 and channel 4 commonly located on the back panel of VCR machines and cable boxes. The difference is that in this case, the switch might be marked "CODEA" and "CODEB", or equivalent.

Maker's Implementation

An alternate decoding format data switch is proposed by my invention to be included in the remotely controlled device. This "switch" feature is best included by a manufacturer in the original design of a VCR-machine or televisor. The advantage to the maker is that user complaints caused by random command interference between two or more clustered entertainment devices is minimized. Even if only one televisor or other device is equipped with the novel features of this invention, that alone may be sufficient to reduce or eliminate problems with interaction between the equipped device and a more primitive, unequipped device.

Set-Top Boxes and Cable Boxes

A particularly beneficial application for my invention is to be embodied in "cable boxes" or "set-top boxes". This occurs because this type of remotely controlled device must be compatible with the largest array of companion devices, such as televisors, VCR machines and so forth. Furthermore, in any region there is generally only one or a few possible cable box variations available. As a result, the desirability for fool-proof operation is more necessarily desired than what the case may otherwise be.

FIELD OF MY INVENTION

My invention generally pertains to televisors, cable boxes, satellite receivers, VCR-machines, DVR-machines and similar equipment ordinarily used in conjunction with a hand held remote controller for establishing their convenient operation. In particular, my invention benefits cable boxes, set-top boxes and satellite receivers to the greatest extent because these class devices must operate with the widest assortment of ancillary apparatus. Furthermore, no viable alternative "make and model" is readily available for replacing a cable box, set-top box or satellite receiver which is bothered by another device's commands. My invention additionally pertains to wireless remote controllers of all types and in particular to portable or hand-held remote controllers commonly used for remotely entering the channel selection commands and other functional instructions into various interoperative combinations of televisors, VCR-machines, DVR-machines, satellite receivers, set-top boxes and cable boxes.

For purpose of this invention the term televisor refers generally to television receiving apparatus, sometimes called a "television set" or, more simply, a "TV set". Televisors are video displays having tunable inputs which may typically select any one of dozens of channels representing video signals modulated on a channel related carrier frequency. Normally the video signals include various categories of program content of interest to the viewer.

More particularly my invention applies to the combined use of several devices of similar or dissimilar make and model, where a command interference is experienced between the devices. For example, this includes where a command is sent to a televisor which causes a spontaneous effect on an associated device, such as a cable box or satellite receiver. It further includes the situation where a particular command sent to the televisor upsets the operation of an associated device by misinterpretation of the command intended for the televisor. In practice my invention directs itself to the problem of co-existing random acting command interference between any plurality of remotely controlled devices influenced by wireless commands originating from a common, or a shared or even several independently co-existent remote controllers.

SUMMARY

The objectionable consequences of random interference between the remote control signals intended for independent recognition by separate remotely controlled devices is frequently encountered by users having numerous pieces of entertainment equipment operating in immediate proximity with each other. More problematic is the occurrence of this type of cross-talk command interference which occurs when both of the remotely controlled devices experience command corruption through mutual interference are committed to be operational at the same time.

Interference by the command signals can create an environment where concurrent remotely controlled entertainment device operation is impossible. An impasse is reached, which also results in a necessity for replacing one of the malfunctioning devices, or isolating the command signal path between the remote controller and each of the interfered-with entertainment devices. Neither of these "solutions" are generally acceptable by the usual consumer-type user.

What I have achieved in my present invention is a new-found ability to operate the same make and even the same model equipment in immediate time concurrency and physical proximity without command interference. What I implement is an extension of present art infrared remote controllers to include at least two alternatively encoded command signals made available for any particular piece of remotely controlled equipment. Meanwhile, I also show that the remotely controlled equipment may be made singularly responsive to either one of the two (or more) alternatively encoded command signals. As a result, the remote controller and the remotely controlled device may be preset to present a different command signal signature for each of even the same make and model remotely controlled device. This resetting to an alternative, or non-standard, code set is accomplished by the owner or user of the equipment by merely flicking a slide switch or in some cases, moving or installing a presetable encoding state jumper.

Various arrangements for operating entertainment devices by remote control are known. In an accompanying U.S. Pat. No. 4,425,647 for "IR Remote Control System" inventors Collins et al depict a remote controller using a preset "hard-wired" encoding scheme adapted for "generating a special code uniquely identifying the selected function, which code is transmitted as an infrared remote control signal". What is lacking in this arrangement and all subsequent art is a capability for changing the "special code" to another code pattern at both the remote controller and the remotely controlled device.

In practice, I have found it beneficial to change the remote controller code pattern to another non-interfering pattern when problems arise. I have found it practical to deliver a remotely controlled entertainment device having a decoder which may be presetably changed between an initial code scheme and an alternate code scheme by use of an user settable switch or, in a televisor, by picking an on-screen menu selection state.

OBJECTIVES

An objective of my invention is to eliminate interference between any combination of several devices operated by a remote controller manifested by instructions directed to one device simultaneously introducing erroneous command activity in another device.

A key purpose for my invention is to enable the use of a plurality of similar or nearly-identical remotely controlled devices as a group, while maintaining distinctively separate and independent command operability from a shared remote controller.

A further goal is to provide for the use of at least two remotely controlled devices situated in physical adjacency without command signal interference causing false instructions in one device when the other device is addressed by the remote controller.

It is an important intent to provide the ability to concurrently use two substantially identical devices, such as two "same make and model" VCR-machines, in an immediate group with the capability for addressing specific commands to either one of the machines in a functionally separate manner using a remote controller, without introducing operational error in the other machine.

It is a further intent to provide an alternate decoding instruction pattern in a remotely controlled device which may be intentionally preselected by a user to substantially reduce, if not eliminate, a likelihood for erroneous interpretation of encoded commands sent to another device by a remote controller.

Additionally, my invention intends that a user may variously establish alternate selections of remotely controlled devices decoding instruction patterns to thereby permit the use of multiple devices grouped in immediate proximity of one-another without experiencing an annoying and sometimes interruptive and erroneous response by one device to a command directed to another device by a remote controller.

My invention also proposes that a remote controller and a remotely controlled device may be preset to an alternate one of at least two distinctly different code data sets by a user accessible switch to thwart command interference introduced by wireless command signals originated from another unrelated device's remote controller.

Lastly, my invention affords the user of the remote controller the capacity for casually entering individual digits composing a channel selection, or other command function, while holding the remote controller where the keypad is plainly visible. Once the entries have been satisfied, the remote controller is merely "aimed" at the remotely controlled device and a SEND button is pressed, whereupon a rapid-fire sequence of command data is sent to submit the channel selection or other command.

DESCRIPTION OF DRAWINGS

My invention is depicted by 13 sheets of drawings showing 13 figures, including.

DESCRIPTION OF INVENTION

Figure 1:
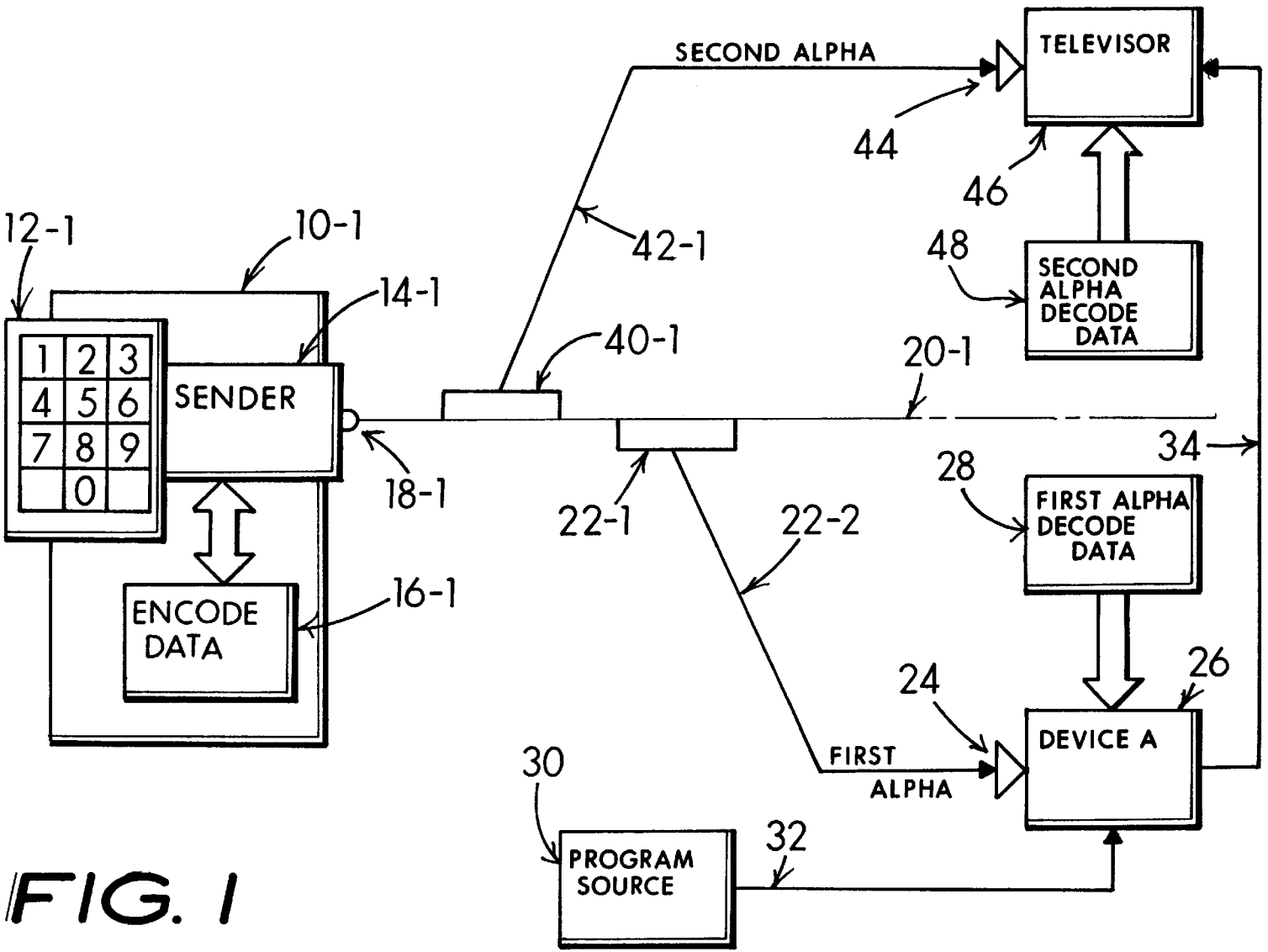
FIG. 1—Representative setup using a shared remote controller acting independently in concert with a televisor and another device such as a cable box.

A remote controller 10-1 shown in FIG. 1 includes a keypad 12-1 allowing a manual entry of channel selections and other commands by a user. In a broad sense, commands may include single or multiple digit channel selections, volume adjustment, play/record controls, fine tuning and other customary controls well known in the art to be enabled by remote controller keypad activity. The individual keypad entries, which might be typified by the prime digit 2 and digit 8 pressed in sequence to define a channel 28 selection, couple with a sender 14-1 that encodes the signal format in accord with proscribed encode data 16-1. The resultant encoded command signal is sent by a wireless device, usually an infrared light emitting diode, 18-1 producing a signal beam 20-1. The first signal beam modulation component 22-1 including first alpha encoded command data is intercepted 22-2 by a receptor 24 portion of a device A 26 such as a "set top box". This remotely controlled device includes a set of first alpha decode data stored in memory 28 that couples with the device-A to decipher the commands.

A program source 30, such as the cable system or the like couples 32 with the input of device-A, while an output from device-A line 34 interlinks with an input of a televisor 46. The televisor also includes a remote control receptor 44 that intercepts 42-1 a portion of the second occurring signal beam modulation component 40-1 including second alpha encoded command data.

Operationally, the remote controller 10-1 may typically be utilized to adjust channel selection settings of the device-A 26 capabilities and to set various commands situations relative with the televisor, not the least of which is to determine the input channel selection compatibility with the interlink signal on line 34 and to adjust audio volume.

Encoding and Decoding "Code" Parameters

In remote control applications it is commonplace to utilize an infrared light beam which is "flashed on and off" in accord with some predetermined code scheme. Furthermore, the encoding may appear as binary state signals impressed upon an underlying carrier that modulates the light beam. These techniques are well known and generally well understood, including a substitution of a radio signal for the infrared beam. As a result, when I speak of encoding and decoding, this shall include techniques which depend upon any variable composing the sent beam. Included are such factors as carrier frequency (typically between 20 and 100 kilohertz) superimposed on the light beam, modulation characteristics including AM, FM, phase modulation and pulse position modulation. Additionally, I include recognizing data rates, pulse widths, pulse spacings, bit-sense (e.g., whether a binary 0 or a 1), pulse interval, pulse pattern recognition and techniques based upon the understood approaches utilized by or derived from the Motorola MC145026P and MC145027P family of encoders and decoders.

Figure 2:
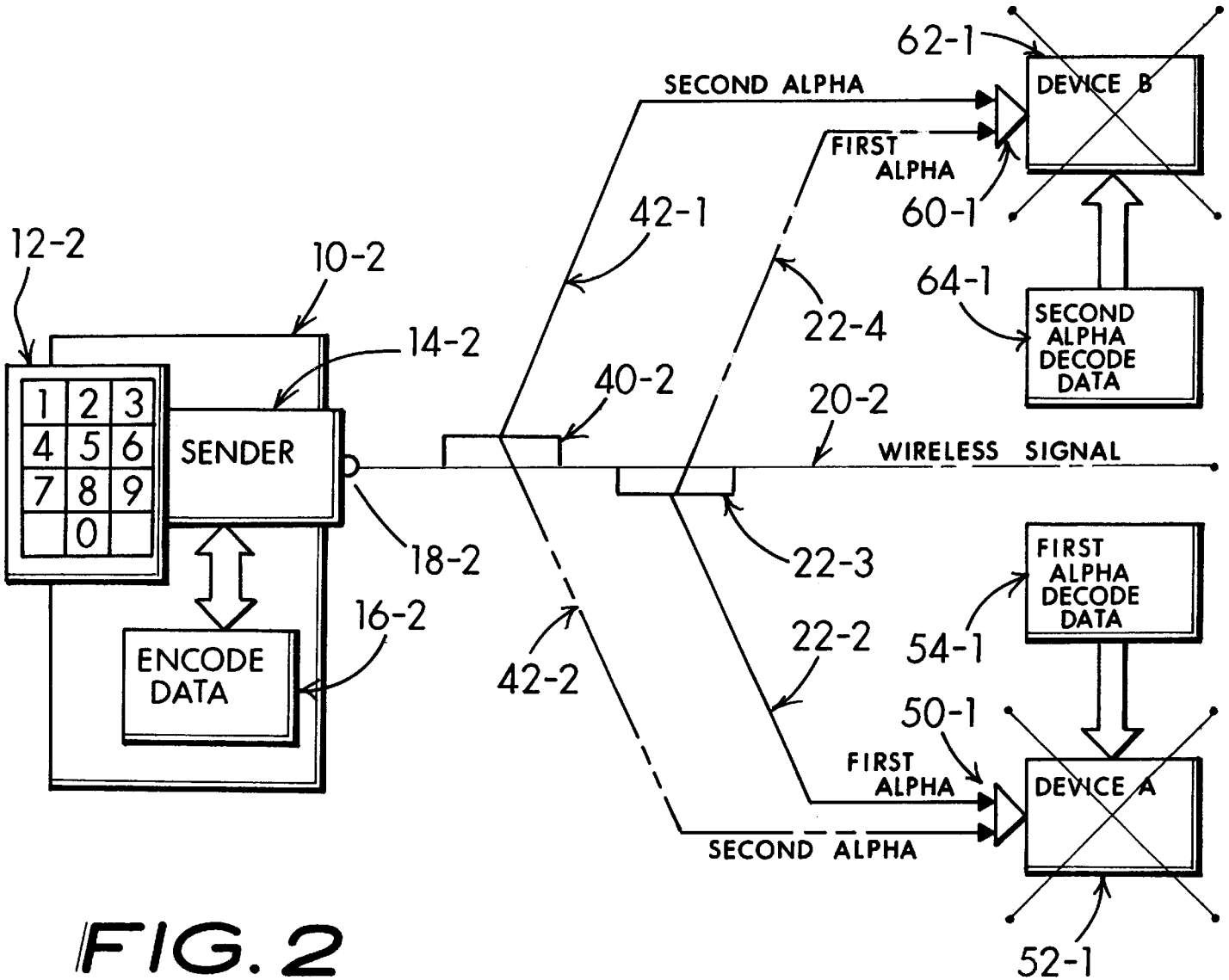
FIG. 2—Representation of interference which may occur between two separate remotely controlled devices using a shared universal remote controller.

Moving on to FIG. 2, you will find a remote controller 10-2 including a keypad 12-2, sender 14-2 and encode data retained in a memory 16-2 suited for sending a command signal beam 20-2 including two separate encoded command signal sequences 22-3 and 40-2. Operation is similar to that mentioned for FIG. 1 wherein the device-A accepts 50-1 first alpha encoded commands 22-2 and the device-B (or televisor) accepts 60-1 second alpha encoded commands 42-1. Similarly, the device-A includes a memory 54-1 providing first alpha decode data and device-B includes a memory 64-1 holding second alpha decode data.

Failure is shown to occur because the first alpha encoded command signal 22-2 intended for the device-A 52-1 also scatters a parasitic signal 22-4 into the receptor 60-1 of the device-B 62-1 where it may cause command interference due to some inadvertent encodement commonality shared between the first alpha decode data 54-1 and second alpha decode data 64-1 formats. As a result malfunctioning of one or more command instructions may occur.

Similarly, a failure in expected command performance may occur because the second alpha encoded command signal 42-1 intended for device-B 62-1 also scatters a parasitic signal 42-2 into the receptor 50-1 of device-A 52-1 where it may inadvertently cause command interference due to some shared binary code state commonality accidentally occurring between the second alpha decode data 64-1 and first alpha decode data 54-1 formats. As a result a further malfunctioning of command functions may occur.

Figure 3:
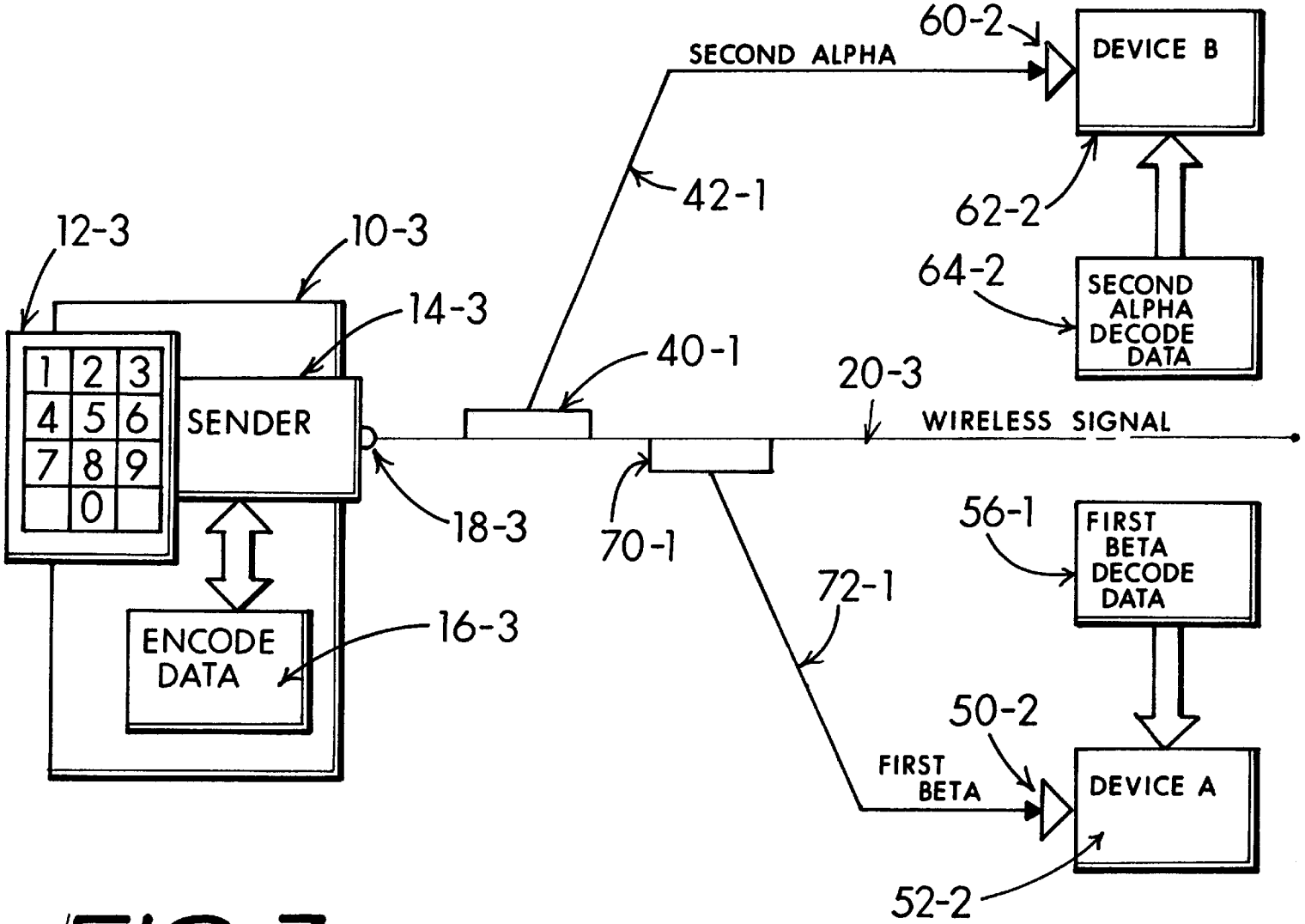
FIG. 3—Redefining one of the remotely controlled devices to utilize an alternate encoding and decoding data set.

In FIG. 3 I show that the remote controller 10-3, including a keypad 12-3, sender portion 14-3 and encode data memory 16-3 emits 18-3 a wireless command signal beam 20-3 including a command modulation signal component 70-1 intended for device-A and another command modulation signal component 40-1 earlier said to couple 42-1 with a televisor, or device-B having a receptor 60-2. In this arrangement I show that the signal component 40-1 is modulated with second alpha encoded data, while I have fully changed the encoding of the other signal component 70-1 from alpha encoding to be represented as first beta encoding determined by the encode data memory 16-3. This command signal is coupled 72-1 with the device-A receptor and deciphered by the first beta decode data held in memory 56-1.

Recognize that this change from an alpha to a beta based encoding data scheme intends that the parasitic interference mentioned relative with FIG. 2 is overcome and command integrity is maintained.

Figure 4:
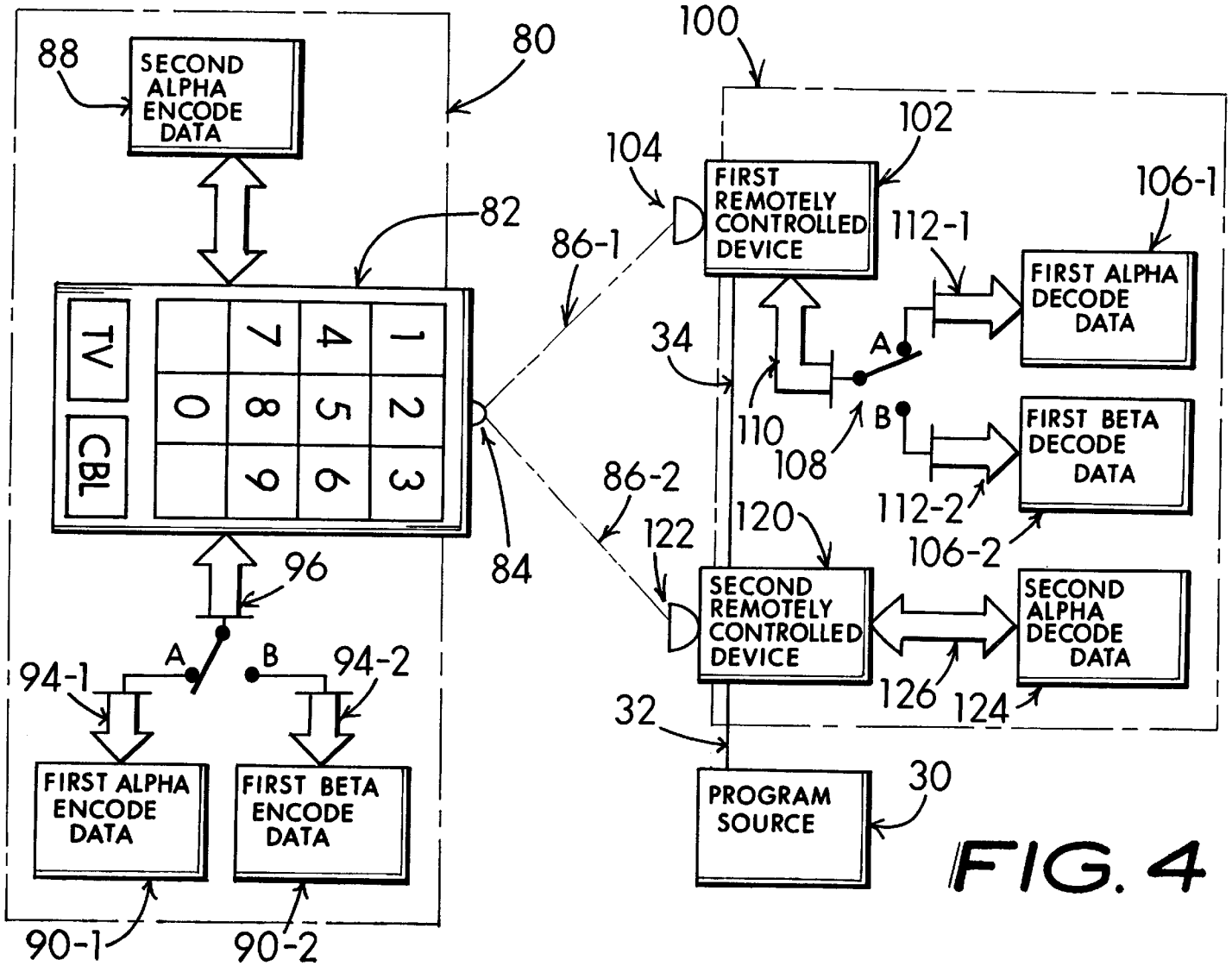
FIG. 4—A remote control system where the remote controller and the remotely controlled device each have selectable alternative encoding and decoding data.

A remote control system is expressed in FIG. 4 showing the essence of my invention to include a portable remote controller 80, including a user actuatable keypad 82. The keypad includes an encoder and sender portion which delivers an encoded infrared beam 86-1,86-2 flowing forth from a light emitting diode (LED) 84 or equivalent source (e.g., a laser diode, etc.). I provide a memory 90-1 storing first alpha encoding data and a memory 90-2 storing first beta encoding data. Similarly, a memory 88 stores second alpha encoding data. In my invention, I preset a switch device 92 to either couple the memory 90-1 data and address lines 94-1 with the encoder data bus 96, or alternatively couple the memory 90-2 data and address lines 94-2 with the encoder data bus 96.

I next show the overall remotely controlled apparatus 100 combination to include at least two remotely controlled devices, such as a televisor and a cable box. The encoded beams 86-1,86-2 emitted by the LED 84 mutually couple with receptors 104,122 included as a portion of the respective first remotely controlled device 102 and the second remotely controlled device 120. From this depiction, you will observe that two memories are included, associated with the first remotely controlled device 102. Realize further that these two or more memories may include a presettable switch 108 having an A position and a B position. In the position A setting the first alpha decoding data memory 106-1 including a data and address bus 112-1 couples with a decoder bus 110 to provide immediate intercoupling between the decoder portion of the first remotely controlled device 102 and the first alpha decoding data memory 106-1. Alternatively, the switch 108 may be preset to the position B and the first beta decoding data memory 106-2 supplants the memory 106-1 data through a coupling of the associated data and address bus 112-2 with the decoder bus 110.

The second remotely controlled device 120 also includes a command signal decoder which is provided with second alpha decoding data stored in memory 124 and intercoupled via bus the data and address bus 126.

In dynamic application, a user may try using the setup with the switch 92 and the switch 108 each set to the A position, e.g. the "first alpha" position. As a result, the first remotely controlled device 102 receives 104 first alpha encoded command data, whilst the second remotely controlled device 120 receives 122 second alpha encoded command data described by the contents of memory 88. Under this mode, if command interference is realized between the signals sent by the encoded wireless beams 86-1,86-2 the user may reset the switches 92 and 108 to the alternative B position, thereby supplanting the first alpha encoding/decoding mode with an alternative first beta encoding/decoding mode. Ordinarily, this may be expected to reduce if not fully eliminate the command interference issue typical of prior art.

Use of a Code Library

A well known setup routine for a remote controller is to retrieve a designated encoding pattern from a code library stored in a memory ordinarily preprogrammed by the remote controller's maker. Representative of this approach is the RCA Universal Remote Control, model RCU1400VP. From the makers own instructions, this remote controller utilizes 3-digit numeral combinations from a printed code list. For example, a General Instrument cable box utilizes a code designator of 003 and a representative Sanyo televisor may use the code designator of 162. By following the maker's instructions, these designators recall the encoding data from a preprogrammed memory device. From the perspective of my invention, this may be called the "alpha" memory and the encoded signal produced by this setup will cooperate with the compatible "alpha" decoding data stored at the remotely controlled device.

My invention expands upon this by including an additional "beta" memory bank as an alternate code library in each the remote controller and the remotely controlled device. As a result, if command interference is encountered, the user may preset the original "alpha" decoding to an alternate "beta" decoding in at least one of the remotely controlled devices. Next, by using a different code designator, the user changes the "alpha" encoding of the remote controller signal for at least one device to a "beta" encoding mode to continue to be compatible. For example, the cable box alpha code designator 003 may be redefined as a beta code by submitting a hypothetical code designator 203, for example. (I say hypothetical because the mentioned RCA model RCU1400VP remote controller example is not intrinsically equipped for beta code settings.) Needless to say, this same alpha and beta alternate encoding/decoding data selection may be intentionally designed as an available inclusion in virtually any maker's combination of remote controllers and remotely controlled devices.

Figure 5:
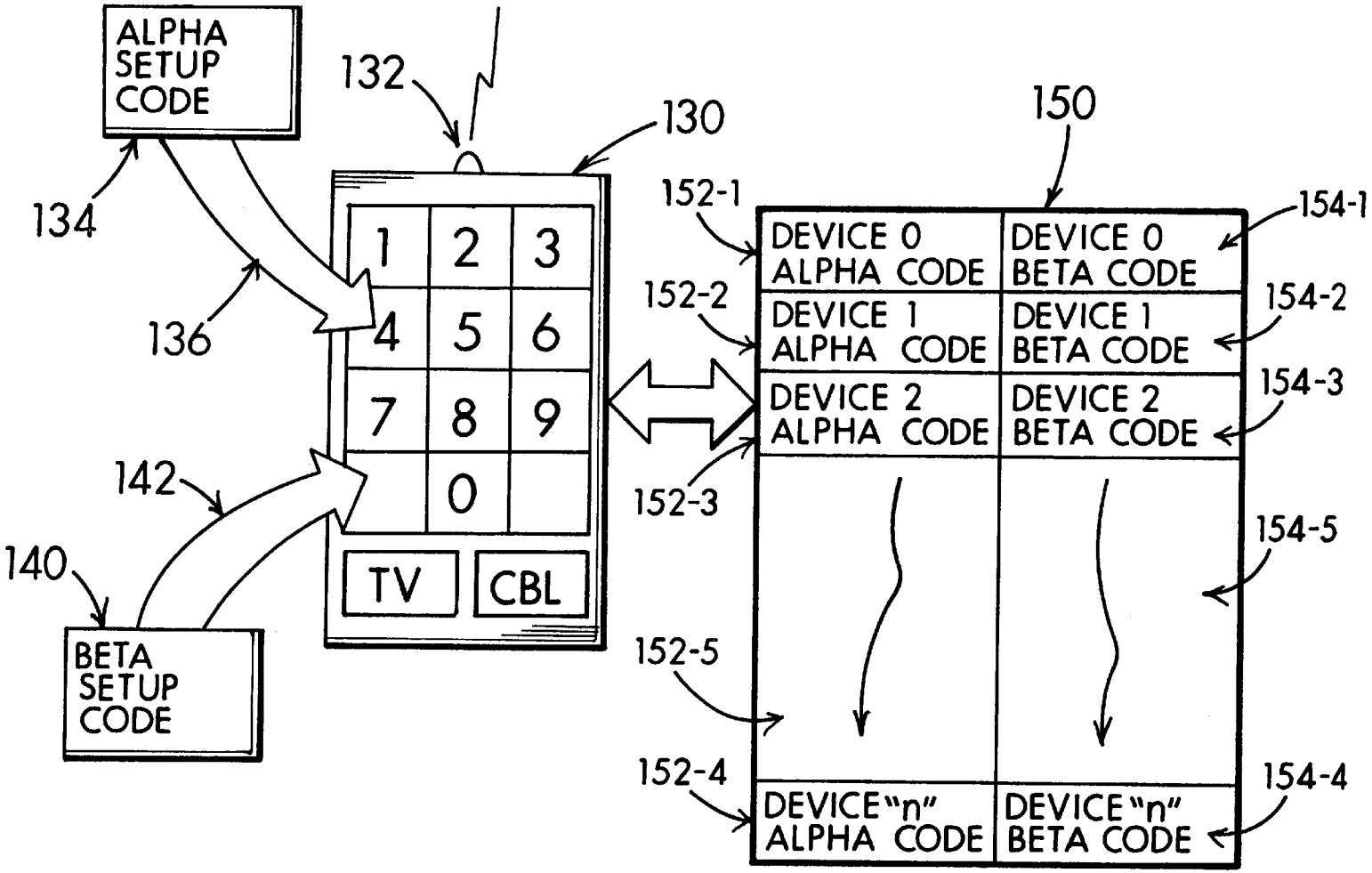
FIG. 5—Utilizing alternative "setup" codes to re-establish alternative encoding data selection in the remote controller.

In FIG. 5 I show a remote controller 130 including a keypad available as a port for entering alpha setup code 134 via a keystroke 136 and alternatively entering a beta setup code 140 via the keystroke 142. A wireless beam 132 emits from the remote controller having an encoding pattern guided by data stored in a memory 150.

As I show, the memory 150 includes two portions, or banks of data. One is the alpha data set, the other being the beta data set. Observe that device-Ø includes its alpha code portion 152-1 and beta code portion 154-1. Similarly, device-1 and device-2 include their special stored code portions 152-2,154-2 and 152-3,154-3. The alpha and beta memory banks are shown to extend 152-5,154-5 through a number of additional possible code settings through a device-n alpha code 152-4 and device-n beta code 154-4 setting. Thoroughly realize that any one of the available alpha and beta code combinations may be selected for any particularly identified controlled device by entry of a unique alpha setup code 134 or beta setup code 140.

Batching Command Instructions

Figure 6:
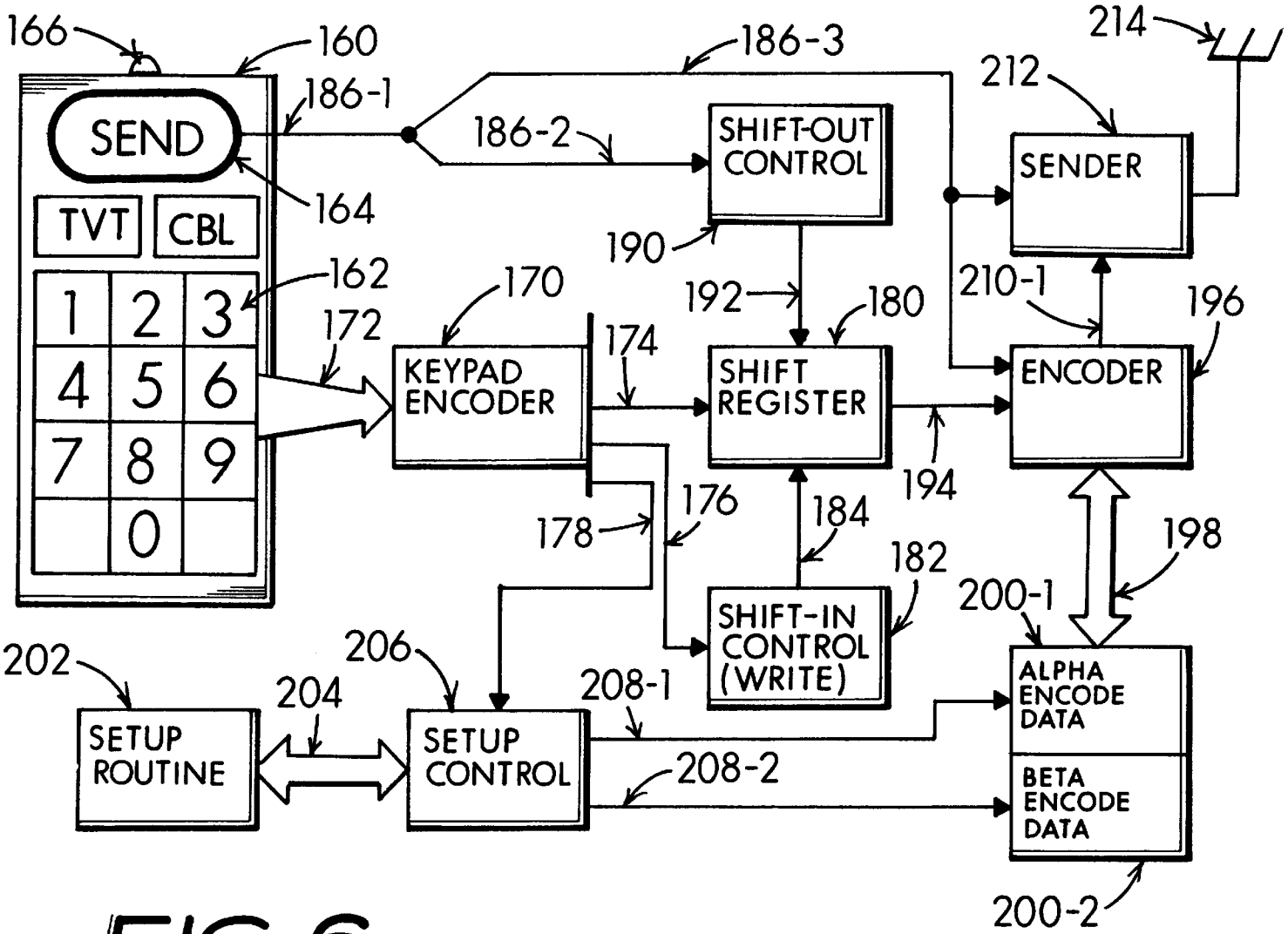
FIG. 6—Including a SEND keybutton permits protracted entry of several keystrokes after which the combination is sent as a sequential batch of data.

A remote controller 160 is shown in FIG. 6 to include a keypad 162, a unique SEND button 164 and the wireless emitter 166. As depicted here, the keypad serves as a manual entry port for user choices coupled 172 with a keypad encoder 170. The keypad encoder adapts the keypad actions into logic signal states on line 174, coupled with an input of a shift register 180. Additionally, each keypress delivers a signal on line 176 to the shift-in control logic (or write logic) 182. In effect, the output 184 from the control logic advances the shift register in synchronization with each data set delivered on line 174. Essentially, if the data set delivered 174 by the keypad encoder is 1-byte wide, the shift register may be configured 1-byte (8-bits) wide or else each byte may be stored as successive nybbles. The primary function of the shift-in control logic 182 is to establish the storage protocol in the shift register 180.

If a user intends to change a channel selection on the cable box to channel 46, the keypad 162 receives manual keypress actions 4 and 6 in succession. These entries are temporarily stored in the shift register 180 in the manner of a scratch pad memory. In other words, the binary states representing 4 and 6 are logically retained in the shift register 180. Once the necessary channel selection entries are completed, the user may press the SEND keybutton .164 therefrom delivering a signal on line 186-1 branching 186-2 to a shift-out control logic 190. This logic function technically parallels the shift-in protocol and delivers the two stored digits 4 and 6 on line 194 to the encoder 296. The delivery is in rapid-fire sequence, obtained subsequent to actuation of the SEND keybutton and not before. As a result, the channel selection digits appear as a burst of data values on line 194 which the encoder 196 as enabled by a signal on line 186-3 acts to encrypt with a signature code determined by one of the alpha encoder data memory 200-1 or beta encode data memory 200-2 coupled 198 with the encoder 196.

The result is an encoded signal on line 210 which urges the sender 212 to deliver a wireless signal 214 as an infrared light beam or radio signal weighted by the user's channel selection values for "channel 46".

During setup of the remote controller, either the alpha mode or the beta mode may be used for encoding. Of course it is essential that the remotely controlled apparatus be preset to be co-responsive to either one of the alpha decoding data or beta decoding data, as previously mentioned conjunctively with FIG. 4. In the classic method, the remote controller is temporarily set to the "setup-mode" and operation is based upon a setup routine 202 that establishes the user's actions to achieve setup. Once the setup-mode is active, the user enters keystrokes representing the setup code values, such as the earlier mentioned value 003 for a General Instrument cable box. As a result of the entry, the keypad encoder delivers the values on line 178 to the setup control logic 206. It is the principal goal of this logic 206 to establish an enabling signal on one of line 208-1 and 208-2 which in the usual case not only enables the appropriate alpha or beta encode data bank but it also serves to address a particular portion of the bank compatible with the remotely controlled device's alpha or beta decoding data set.

Figure 7:
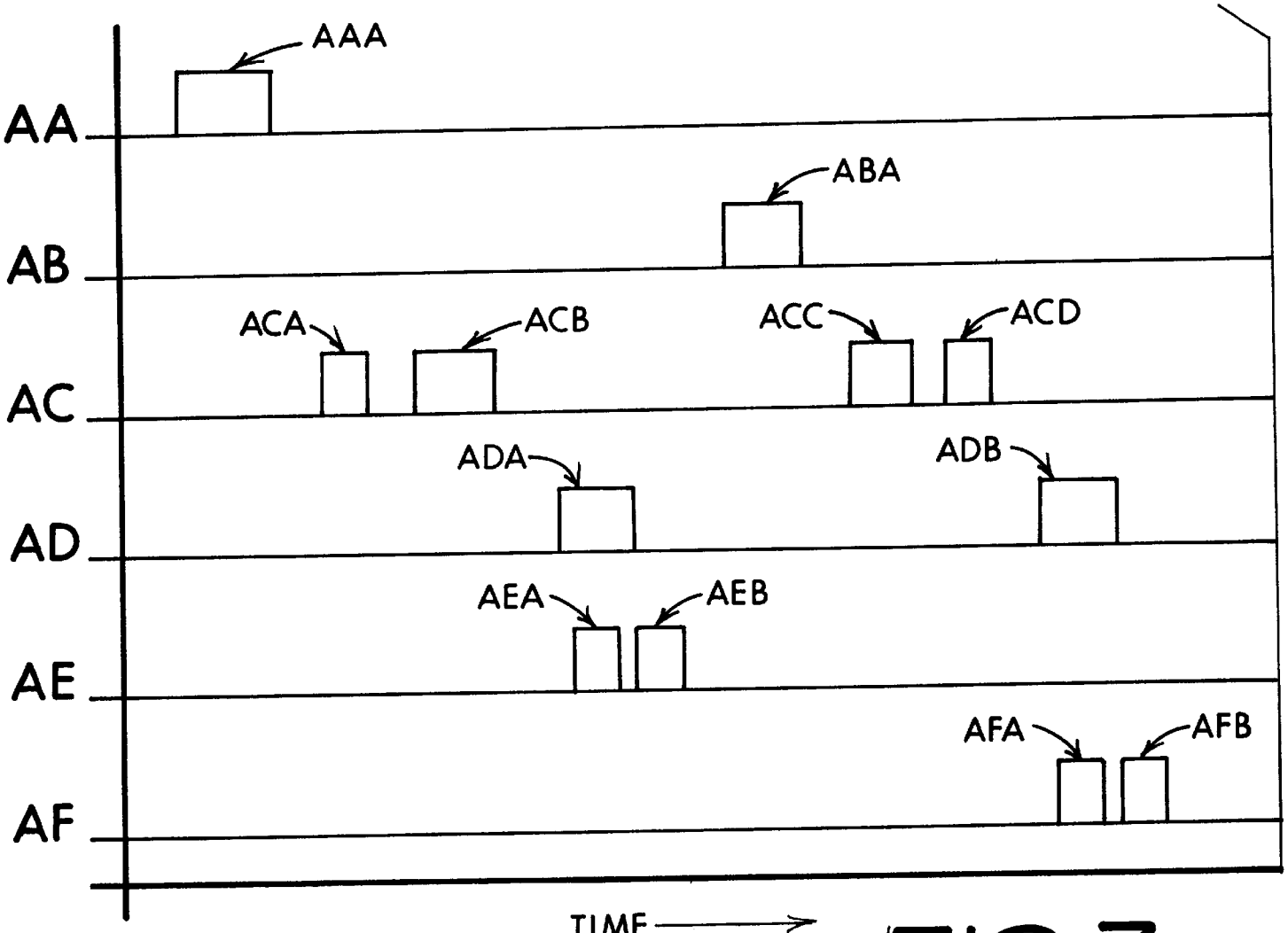
FIG. 7—Graphical diagram showing the batching of keystrokes which are released as wireless command signals by a SEND key entry.

Data flow patterns presented by the representative embodiment of FIG. 6 is shown now by waveforms depicted in FIG. 7. Line AA intends showing the actuation AAA of the TV keybutton portion of the remote controller 160. This "selects" the TV device whereafter keybutton entries on line AC depict the entry of two channel selection values, such as Ø ACA and 3 ACB. This is followed by an actuation of the SEND keybutton 164 shown on line AD as state ADA. This immediately initiates the sequence of stored channel selection values, shown on AE as AEA=Ø and AEB=3, which are subsequently sent to the televisor.

Next in sequence line AB intends showing the actuation ABA of the CBL (cable box) keybutton portion of the remote controller 160. This "selects" the cable box device whereafter further keybutton entries on line AC depict the entry of two channel selection values, such as 4 ACC and 6 ACD. These entries are followed by the next actuation of the SEND keybutton 164 shown on line AD as state ADB. The SEND entry immediately initiates the sequence of stored channel selection values, shown on AE as AFA=4 and AFB=6, which are subsequently sent to the cable box.

Figure 8:
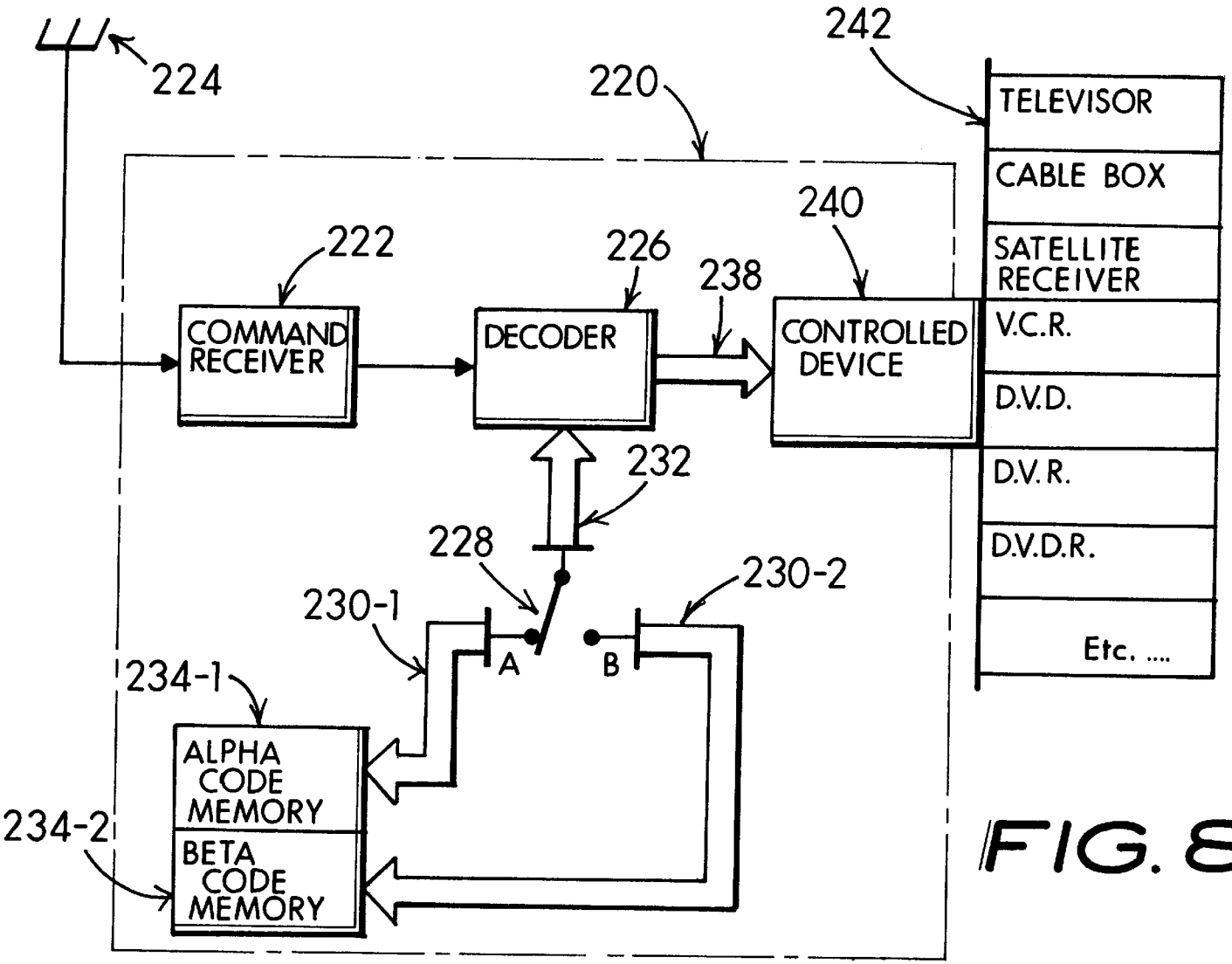
FIG. 8—A remotely controlled device utilizing alternately selectable sets of decoding data.

The controlled device which may be associated with the remote controller of prior FIG. 6 is now shown by FIG. 8. The configuration 220 includes a command signal receptor 224 coupled with a command receiver 222 which applies incoming signals to a decoder 226. The decoder utilizes one of the alpha code memory 234-1 or beta code memory 234-2 data sets to determine decoding state recognition of an incoming encoded command. A preferred alpha code set 234-1 may be selected by switch 228 as coupled by setting-A with the encoder 226 by data bus lines 230-1,232. In event of objectionable interference with another device, the switch may be changed to setting-B whereby the beta code memory 234-2 is actively coupled through data bus lines 230-2,232 with the decoder.

The decoded command signals deliver on bus line 238 with the controlled device 240, that may include 242 a televisor, cable box, satellite receiver, VCR-machine, DVD-machine, DVR-machine, DVDR-machine or any of a number of other devices.

Figure 9:
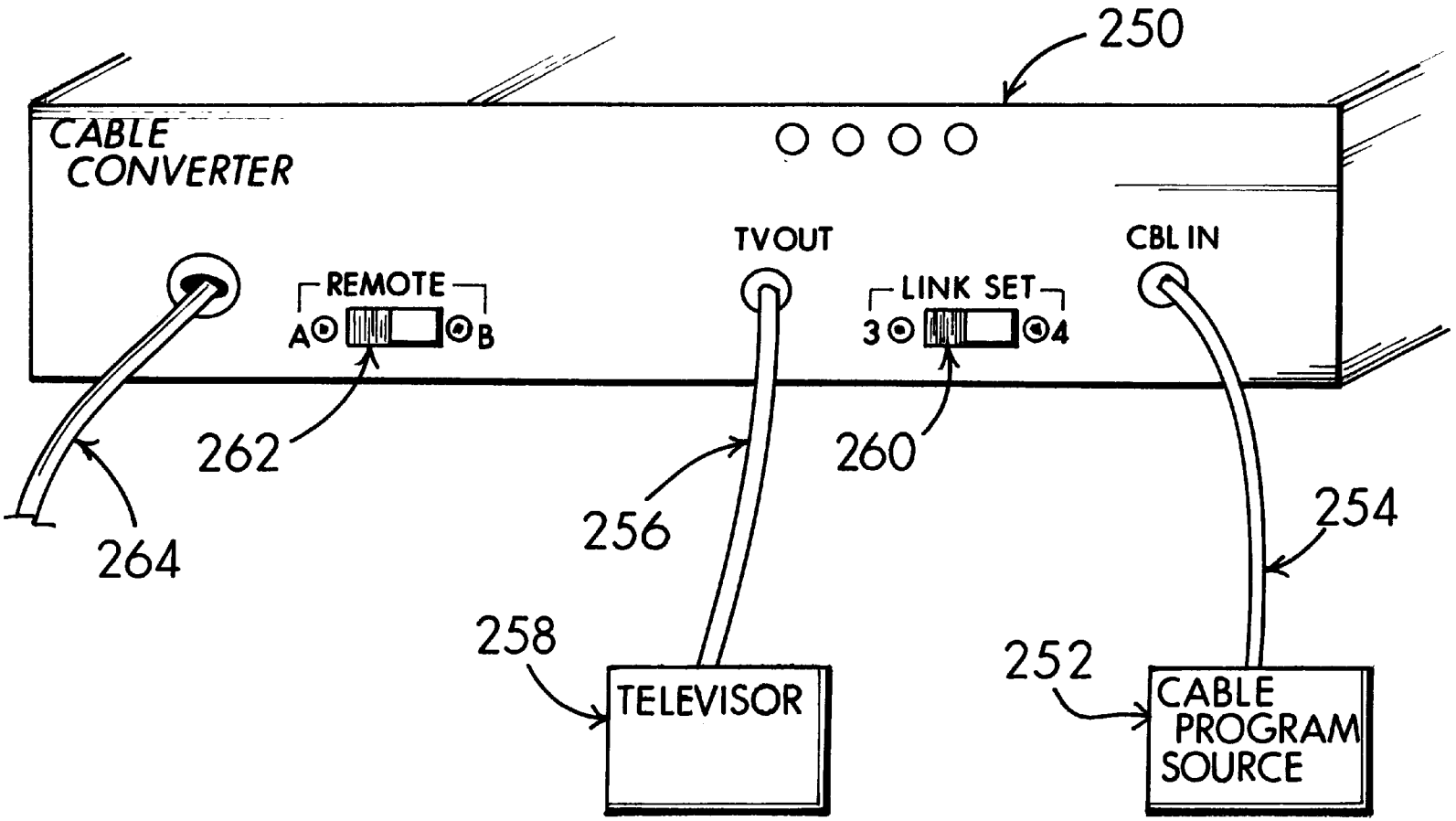
FIG. 9—Rear view of a cable box (or VCR-machine) showing the novel REMOTEA and B selection preset switch.

The back panel of a representative cable converter 250 (or similarly, a VCR-machine, etc.) shows in FIG. 9 to include a cable program source 252 (such as the cable network connection) coupled 254 with an input. A televisor 258 is also shown coupled 256 with an output from the cable box 250. As with usual practice, a small switch 260 allows selection between "channel 3" and "channel 4" for the signal outputted from the cable box on line 256, as coupled with the televisor 258.

My invention's novelty is presented as an additional switch 262 which enables the user to preset the remote control decoding to an "alpha mode" A or a "beta mode" B. Electric power couples through a line-cord 264, as is usual practice.

Figure 10:
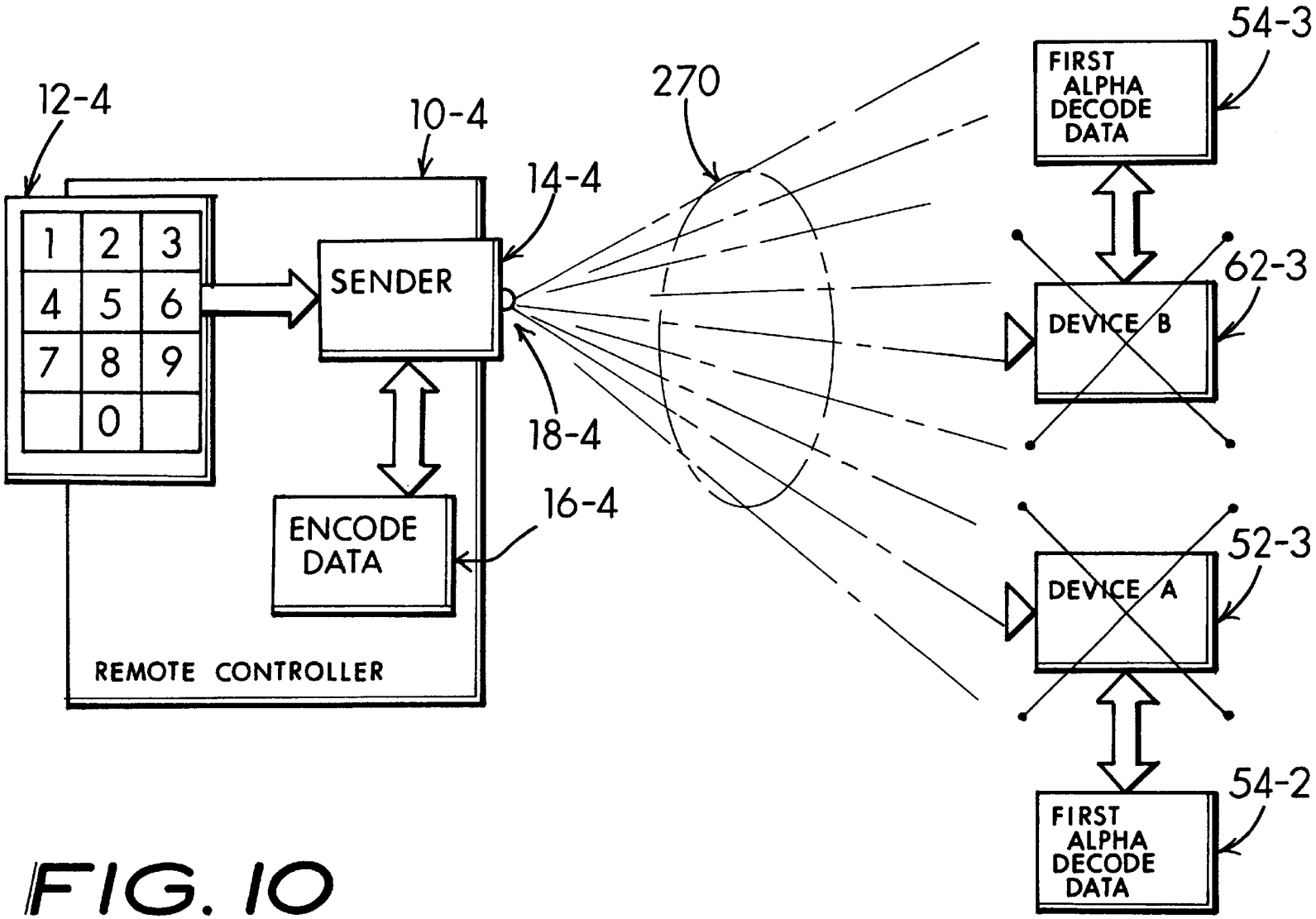
FIG. 10—Overview of profound interference of command signals obtained between two devices utilizing substantially the same decoding data set.
Figure 11:
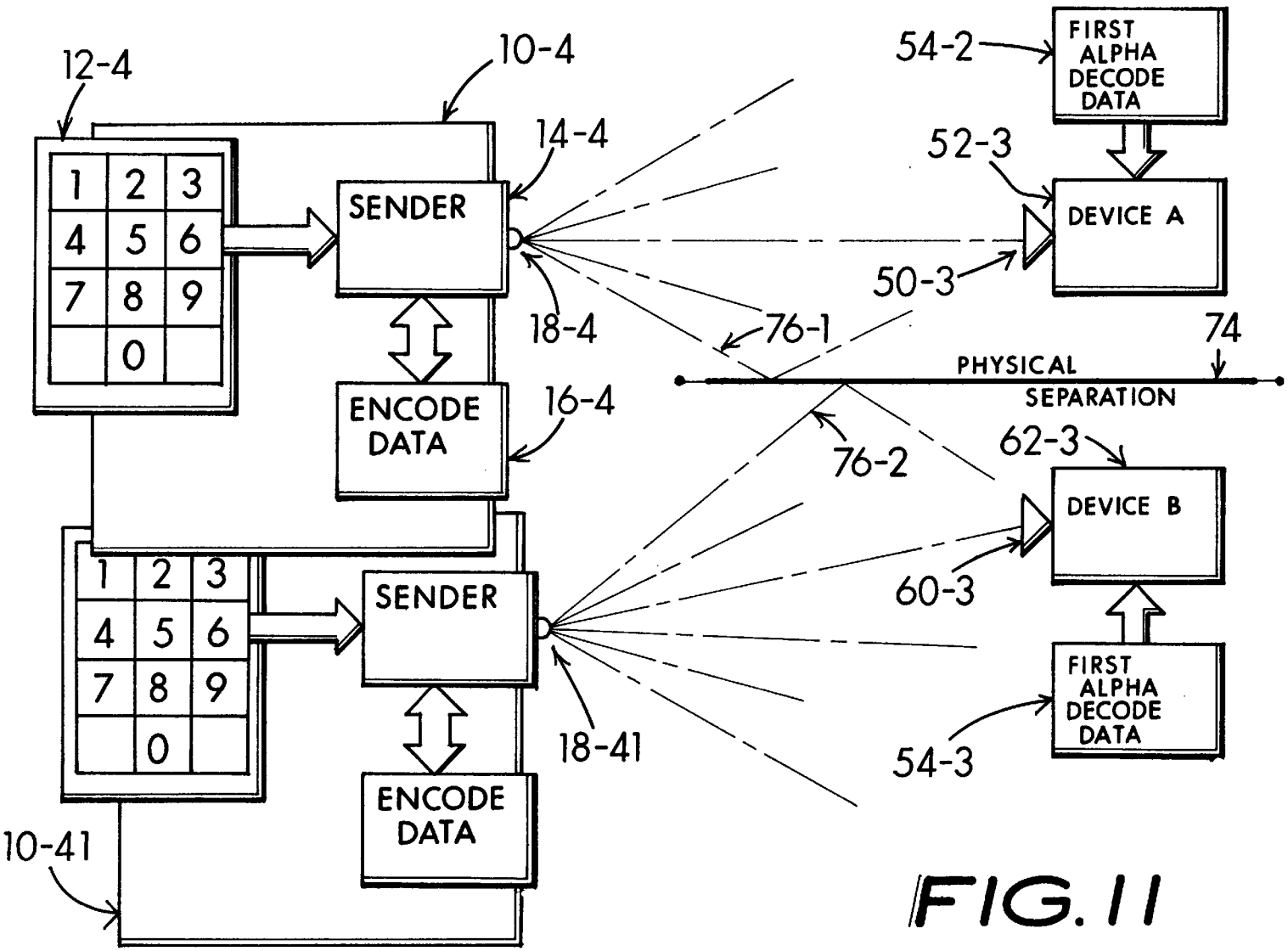
FIG. 11—Work-around scheme to permit two substantially identical remotely controlled devices to be operated by a shared remote controller.

In FIG. 10 I show a remote controller of prior art configuration. This illustrative effort depicts one of the fundamental problems with current art, where two remotely controlled devices may attempt concurrent operation.

The usual remote controller includes a keypad 12-4, sender 14-4 and a source of encoding data 16-4. This is a representative configuration for a typical Universal Electronics Inc. model URC-21000 series in which an "alpha mode" memory alone is provided, with no "beta mode" option as expressed by this invention's objectives. In this configuration, I show trying to use two "same kind" of remotely controlled devices. For example, this may include two "same make and model" VCR machines, hooked together to duplicate family album video tapes (such as from a wedding, anniversary, etc.). As shown, commands originated by the remote controller signal beam source 18-4 splay out 260 to encounter the receptors 50-3 and 60-3 with similar efficacity. Since both devices 52-3,62-3 have similar "first alpha" decode data stored in their respective memories 54-2,54-3 a substantial interference problem arises for both devices 52-3,62-3 as depicted by the crossed-out appearance. In plain words, two "same-make and same-model" devices 52-3,62-3 do not mutually work together from the shared remote controller 10-4.

In an attempt to use two similar VCR-machines together for video tape duplication, I found a "fix" which enabled a reasonable extent of usefulness continuing to utilize a shared remote control 10-4 for the two devices 52-3,62-3 with a minimum of parasitic command interaction. The solution was rather brute force and included placing a physical separation barrier 74 interventionally positioned between the receptive angle of the receptors 50-3 and 60-3. As this shows, the emitter 18-4 throws its principal signal beam towards the receptor 50-3 and the scattered beam rays 76-1 which might impinge receptor 60-3 are deflected by the separator 74. Similarly, when the remote controller is repositioned, as shown by remote controller site 10-41, the associated command signal emitter 18-41 throws its principal beam components towards the receptor 60-3 and scatter rays 76-2 are deflected aside by the barrier 74, prevented from reaching the receptor 50-3.

Microprocessor CPU

Figure 12:
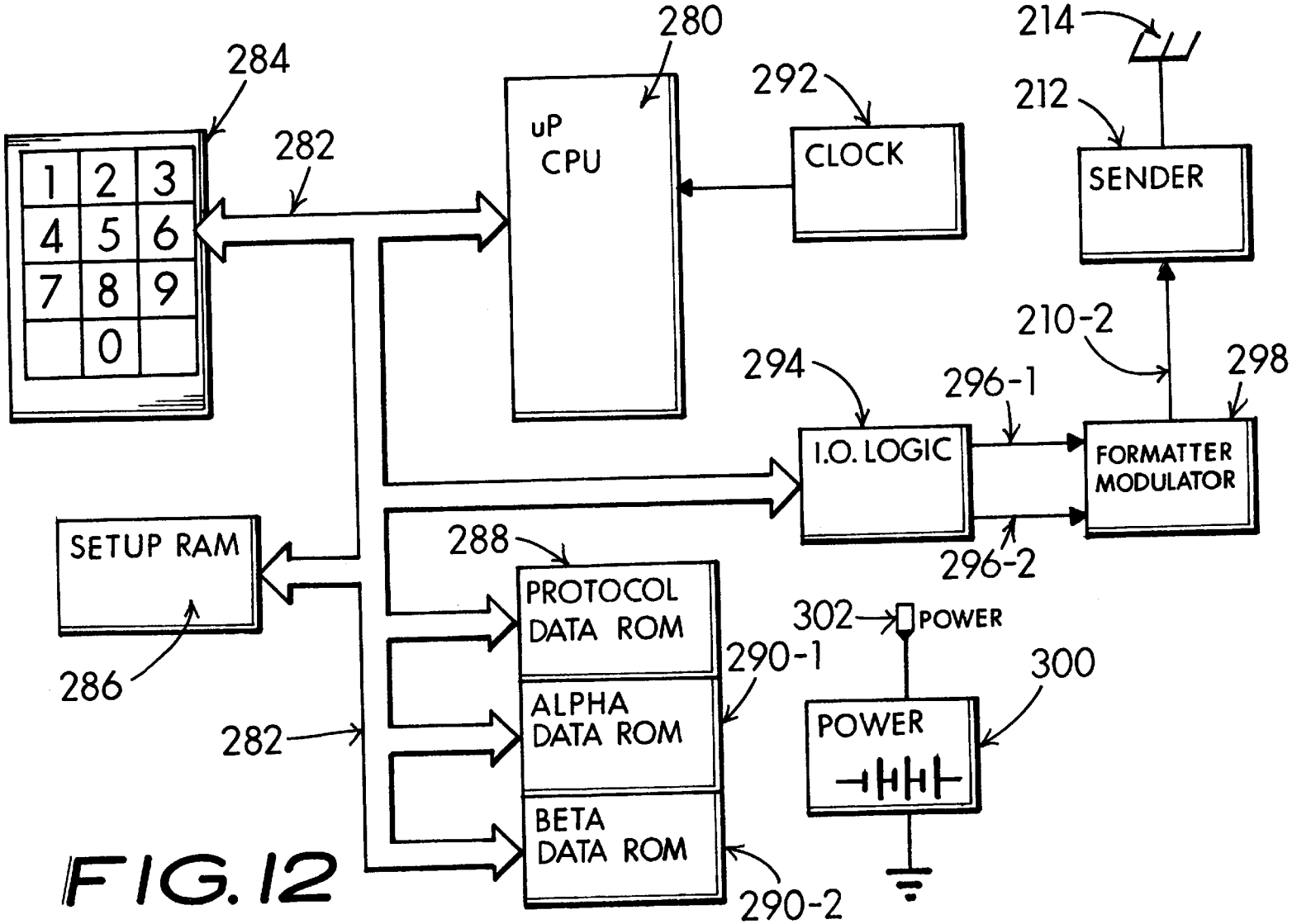
FIG. 12—Use of microprocessor CPU shown as embodiment.

Contemporary remote controllers commonly utilize microprocessors for their various operational requirements. In FIG. 12 I show a microprocessor 280 used as a CPU and to include a data (signal) bus 282. The CPU is operated by a clock 292. The CPU address and data lines couple with the keypad 284. In the practical operation of the remote controller, the keypad is typically arranged as a switch matrix which is scanned by the CPU data bus lines 282.

Operating Protocol in ROM

The CPU also interfaces with a setup RAM 286 and protocol data ROM 288. The protocol data ROM stores software instructions which essentially "brings life" to the operation of the CPU and other elements. In essence, the protocol data ROM establishes the "personality" of the remote controller including how it interfaces with a user and what it sends to a remotely controlled device. The setup RAM on the other hand, holds temporal instructions which might include a designation for which make and model device is being remotely addressed by the remote controller.

Generally, the setup RAM 286 holds preset information manually entered through the keypad port by the user. Typically this may include the code library value, typified by a 3-digit or 4-digit number.

Encode Data in ROM

An alpha data ROM 290-1 and beta data ROM 290-2 are provided, where each may include a library of various device instructions. Conversely, the remote controller may be dedicated to only one make and model controlled device, or else a family of controlled devices made by one manufacturer. These are all well known variations on the art.

An input/output IO-logic function 294 adapts the data and control signals presented on the bus 282 into encoded command signals, usually superimposed on a carrier. The carrier may be set in the range between about 20-kilohertz and 100-kilohertz, more or less. Of course, the encoded command signals which modulate the carrier in the formatter-modulator function 298 are reflective of the command encryption data stored in the active (selected) alpha or beta ROM 290-1,290-2. The command signal delivered from the formatter-modulator 298 on line 210-2 is translated as a wireless signal 214 delivered by the sender 212.

D.c. power 302 for operation of the various circuits may be provided by a battery power supply 300.

Figure 13:
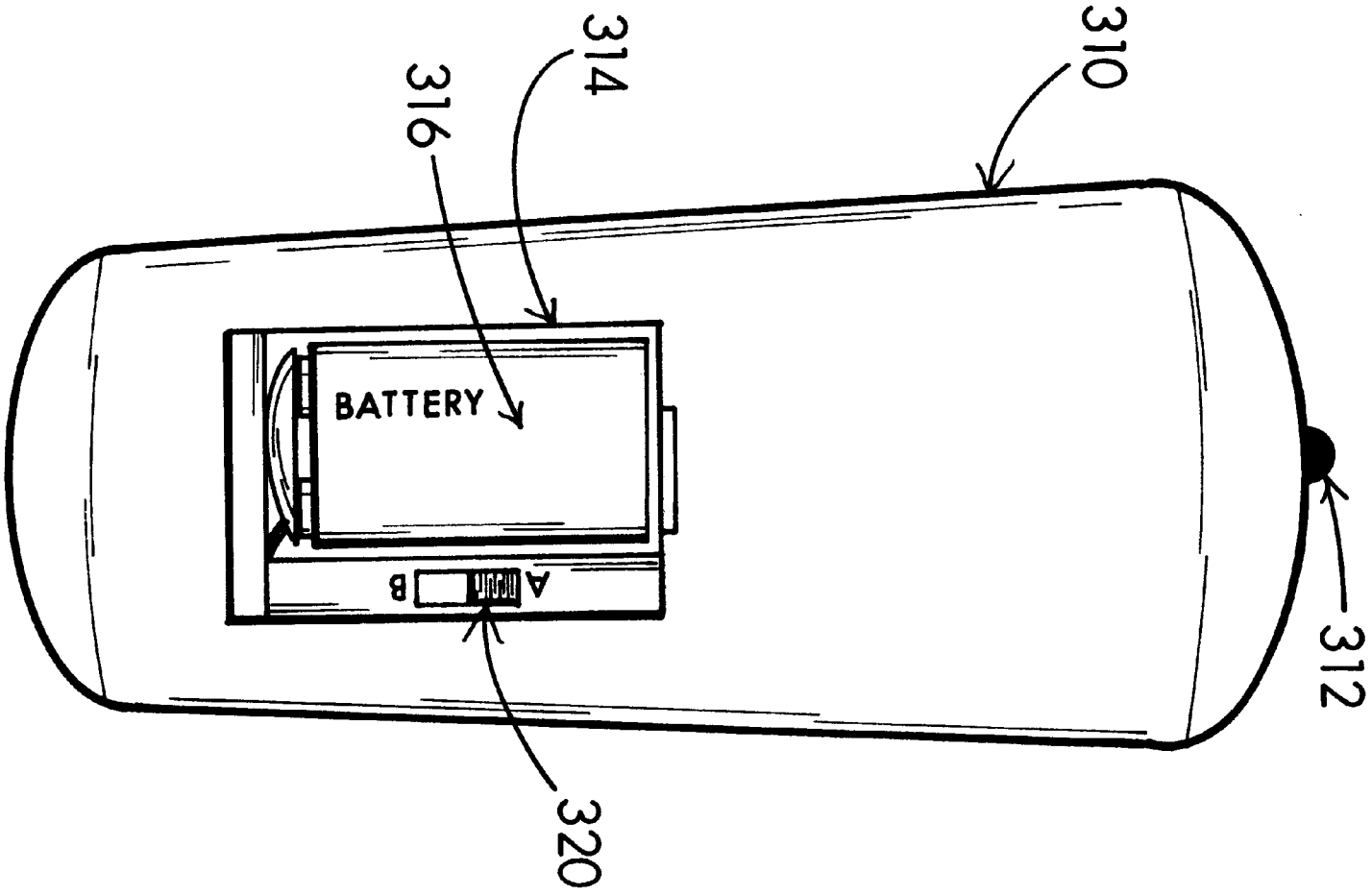
FIG. 13—Rear-view of a remote controller depicting alpha or beta encoding mode selector switch.

A backside depiction of a remote controller 310 is shown by FIG. 13 to include a battery compartment 314, usually including a removable cover (not shown). A battery 316 is shown installed, as a representative source of D.C. power 300. This illustration shows an encryption mode switch 320 which may select between an A data set selection (alpha data ROM 290-1) and a B data set selection (beta data ROM 290-2). This arrangement is primarily applicable to proprietary, or device-specific, remote controllers. In other words, the device such as a set-top box, particularly includes a selectable alpha or beta decoding preset.

Reasonable and comprehensive effort has been made to explain this invention in a manner which may enable a person of ordinary skill in the art to duplicate my findings. The utter essence of my invention is to provide a user with an alternative remote control encoding scheme which reduces a likelihood for command interaction between several remotely controlled devices used at the same time. I fully expect that a skilled artisan may develop alternate details for my invention's implementation including a considerable variation regarding physical form, keypad access, electrical hookup, hardware detail, data storage techniques, encoding methods, software configuration and obvious operational preferences. I say that these obvious variants occur as a natural outspread from the invention's central novelty. They naturally result from mere applied engineering skill coupled with an ever-increasing plethora of options regarding parts, components, techniques and programming skills which may be utilized to duplicate my invention's contribution to the artfield.

Any attempt by another to circumvent the essence of my invention shall be prudently viewed with caution and suspicion. I realize that hindsight may make other physical and technical embodiments exhibiting a difference in operational detail from that which I specifically depict readily apparent to and subsequently tried by others. As a consequence to this realization, all technical hookup, signal processing and physical embodiment variations irrespective of their extent, shall be found as merely obvious modifications to my invention's fundamental teachings and therefore to be irrefutably within the scope of my invention as presently taught and claimed.

I claim for my invention:

1. A remote control method for allowing a plurality of related entertainment appliances to operate in the same environment, comprising the steps of:

immutably storing in a remote controller a first alpha encoding data set, a second alpha encoding data set, and a first beta encoding data set, wherein the signals corresponding to the first alpha encoding data set are different from the signals corresponding to the second alpha encoding data set, and wherein the remote controller is selected to send only the signals from one of the encoding data sets;

immutably storing in a first remotely controlled apparatus a first alpha decoding data set;

immutably storing in a second remotely controlled apparatus a second alpha decoding data set and a first beta decoding data set, wherein the second remotely controlled apparatus is selected to use one of the decoding data sets;

wherein the decoding data sets are used to decode the signals from their respective encoding data sets;

utilizing a keypad to enter a command to cause the remote controller to send a first alpha encoded data signal to the first and the second remotely controlled apparatus;

using the first and the second remotely controlled apparatus to receive the encoded data signal;

using the first and the second remotely controlled apparatus to decode and to execute the command corresponding with the signal if the decoding data set is compatible with the first encoding data set;

observing that the second remotely controlled apparatus improperly decodes and executes the first alpha encoded data signal; and switching the second remotely controlled apparatus to an alternative decoding data set.

2. The remote control method of claim 1 further comprising:

submitting the user command into the keypad as a plurality of individual keystrokes;

accumulating and storing keystroke data;

manually actuating a designated send key;

retrieving the stored keystroke data; and sequentially sending the stored keystroke data as a first or second alpha encoded wireless signal or a first or second beta encoded wireless signal.

3. The remote control method of claim 1:

wherein the switching is performed by a local switch on one of the remotely controlled apparatus.

4. The remote control method of claim 3:

wherein the remote controller has a switch for switching between coding sets.

5. The remote control method of claim 1:

wherein the code sets represent the commands associated with a particular make and model of remotely controlled apparatus.

6. A remote control method comprising the steps of:

integrally coupling a first remotely controlled device with a second remotely controlled device;

storing a first alpha decoding set and a first beta decoding set in the first remotely controlled device, wherein only one decoding set is selectively active;

storing a second alpha decoding set in the second remotely controlled device;

storing a first alpha encoding data set, a second alpha encoding data set, and a first beta encoding data set in a portable remote controller, wherein the encoding data sets correspond with the decoding data sets and only one encoding data set is selectively active;

causing the remote controller to send at least one command as a first alpha encoded signal to be received and decoded by the remotely controlled devices;

causing the remote controller to send at least one command as a first beta encoded signal to be received and decoded by the remotely controlled devices;

observing the operational response by the remotely controlled devices from the first alpha encoded signal and the first beta encoded signal to determine which encoded signal results in better control of the devices; and selecting in the first remotely controlled device the decoding set that respond to the signal with better control.

7. The remote control method of claim 6:

wherein the remote controller is a universal remote controller.

8. The remote control method of claim 6:

wherein the switching between encoding sets is achieved by a user actuated switch on the remote controller.

9. The remote control method of claim 6:

wherein the switching between decoding sets is achieved by a user actuated switch on the first remotely controlled device.

10. The remote control method of claim 6 further comprising:

entering at least one non-zero digit value into a keypad of the remote controller to form a channel command;

storing the channel command;

entering a send command;

retrieving the stored channel command;

prefixing a leading zero to the channel command if the channel command is a single digit value; and transmitting the leading zero and the channel command as a first alpha encoded signal.

11. The remote control method of claim 6, further comprising the steps of:

storing the first alpha decoding data set and the first beta decoding data set in separate storage banks of the first remotely controlled device; and switching between the storage banks to select the decoding data set during initial setup of the first remotely controlled device.

* * * * *